United States Patent [19]

Baer

[11] Patent Number: 4,996,739

[45] Date of Patent: Mar. 5, 1991

[54] THRUST BEARING ASSEMBLY FOR HINGE STRUCTURE

[76] Inventor: Austin R. Baer, 1115 N. Ellsworth, Villa Park, Ill. 60181

[21] Appl. No.: 432,573

[22] Filed: Nov. 6, 1989

[51] Int. Cl.[5] ..... E05D 7/00

[52] U.S. Cl. ..... 16/354; 384/420; 384/906

[58] Field of Search ..... 16/354, 273, 380, DIG. 27; 384/420, 906

[56] References Cited

U.S. PATENT DOCUMENTS 3,092,870 6/1963 Baer ..... 16/354

3,402,422 9/1968 Baer ..... 16/354

*Primary Examiner*—Richard K. Seidel

*Assistant Examiner*—Carmine Cuda

*Attorney, Agent, or Firm*—Gravely, Lieder & Woodruff

[57] ABSTRACT

A thrust bearing assembly for a hinge structure having two geared hinge members and a clamp member. The geared hinge members are maintained in rotatable, intermeshing relation along their adjacent longitudinally extending edges by the clamp members to permit smooth and uniform movement of the hinge structure. The thrust bearing assembly of the present invention includes a pair of non-metallic interconnected inserts arranged in side-by-side order to extend laterally across and inhibit relative longitudinal movements between the hinge members. The interconnected inserts are configured to facilitate their insertion in and removal from the hinge structure while maintaining the hinge members in mesh.

13 Claims, 3 Drawing Sheets

THRUST BEARING ASSEMBLY FOR HINGE STRUCTURE

FIELD OF THE INVENTION

The present invention relates to pinless hinge structures and, more particularly, to an improved thrust bearing assembly for inhibiting relative longitudinal movement between hinge members of a pinless hinge structure.

BACKGROUND OF THE INVENTION

A hinge structure normally includes two hinge members which are rotatably secured together by a pin or the like. Automatically operated doors, such as those commonly used in shopping centers, schools, drugstores, or the like are continually operated and are substantially heavier and larger than those used in most homes. As will be understood, continual use of the door submits the hinge structure to extensive wear. Notwithstanding their continual use and the substantial load placed thereon, a hinge structure is expected to perform error free and with minimum maintenance.

Increases in height and/or weight of the door or the like carried by the hinge member, adds to the frictional sliding contact between the hinge members and thereby increases the wear on the hinge structure. As may be appreciated, and despite the wear on such hinge structures, the hinge members are not normally permitted to longitudinally move relative to each other during operation.

My U.S. Pat. No. 3,092,870, dated June 11, 1963, discloses a pinless hinge structure offering increased performance and durability. Such a hinge structure includes two longitudinally extending hinge members which are rotatably joined along adjacent longitudinal edges by intermeshing gear segments forming part of the hinge members. A clamp member maintains the gear segments in mesh relative to each other while permitting smooth and uniform movement of the hinge members through a full arc of travel of the hinge. The hinge structure can be formed from a wide variety of metals and plastic materials, and can be manufactured by extrusion, rolling, drawing, machining, molding, and other forming operations.

The design and performance of the hinge structure disclosed in the above-identified patent was further enhanced through the provision of a longitudinal thrust bearing which was the subject of my U.S. Pat. No. 3,402,422, dated Sept. 24, 1968. My patented longitudinal thrust bearing comprises a solid bearing member disposed in longitudinally co-extensive recesses formed in adjacent longitudinal edges of each rotatable hinge member. The longitudinal dimensions of the bearing member and the recesses in which the bearing member is disposed are such that upper and lower surfaces of the recesses slidably contact upper and lower bearing surfaces of the bearing member disposed therein whereby inhibiting longitudinal movement of one hinge member with respect to the other hinge member.

Preferably, several thrust bearings are longitudinally spaced along the length of the door to distribute their load bearing capability. Despite their improved performance, and because of the continual relative sliding engagement between its upper and lower surfaces, such thrust bearings do, on occasion, require replacement.

Replacement of any or all of the thrust bearings normally requires complete disassembly of the hinge structure from the associated door. As will be appreciated, repairs on a door leading to a commonly frequented building such as a school, hospital, or the like interrupt or limit accessibility to such a building. Even if only for a short time period, such interruptions to building access are undesirable and therefore, should be maintained to a minimum if not eliminated. As will be appreciated, the ability to replace the thrust bearing assembly without requiring disassembly of the hinge structure from the associated door would greatly reduce the time required to perform maintenance thereon, reduce maintenance costs, and reduce disruptions to store access.

SUMMARY OF THE INVENTION

In view of the above, and in accordance with the present invention, there is provided an improved thrust bearing assembly for a hinge structure having two hinge members which are rotatably joined along their adjacent longitudinal edges in a manner permitting smooth and uniform movement of the hinged members through a full arc of travel of the hinge structure. The thrust bearing assembly of the present invention includes a pair of interconnected inserts which extend laterally across the hinge members of the hinge structure to inhibit longitudinal movement of the hinge members relative to each other. The interconnected inserts are configured to facilitate complete replacement of the bearing assembly by readily allowing insertion and removal of the inserts relative to the hinge structure without requiring disassembly of the hinge members thereof.

As illustrated, the hinge members of the hinge structure are rotatably joined along their adjacent longitudinal edges by gear segments which are maintained in intermeshing engagement by a clamp member. The clamp member is configured with longitudinally extending, inwardly turned ends about which the hinge members rotate. Co-extensive lateral recesses are defined along adjacent longitudinal edges of the hinged members.

The inserts defining the thrust bearing assembly of the present invention are removably disposed in the longitudinal recesses defined by the hinge members in side-by-side relation relative to each other. The inserts define co-extensive upper and lower bearing surfaces which slidably engage upper and lower surfaces of the recesses defined by the hinge members in a manner inhibiting relative longitudinal movement of the hinge members. In a preferred form, each of the inserts is formed from a non-metallic material for reducing the frictional contact between the inserts and the hinged members and thereby advantageously increasing the durability of the bearing assembly.

The inserts of the bearing assembly are joined along adjacent longitudinal edges which are configured to permit selective rotation of the inserts relative to each other. As illustrated, the adjacent longitudinal edges of the inserts are provided with complementary convex and concave profiles which permit one insert to be selectively rotated relative to the other. In a preferred form, and to inhibit relative longitudinal movement between the inserts and thereby the hinged members, the inserts are joined to each other by a tongue-and-groove configuration defined along their adjacent longitudinal edges.

An opposite longitudinal edge of each insert is configured to define a longitudinally extending open-sided channel. In a preferred form, each channel has a generally C-shaped cross-sectional configuration which accommodates an inwardly turned end of the clamp member while permitting ready removal of the insert from the recesses provided in the hinge members upon selective rotation of one insert relative to the other.

The thrust bearing assembly of the present invention is further provided with a device or mechanism for inhibiting inadvertent rotation of the inserts relative to each other. In one form, a laterally extending tab on one insert may be press-fit into a laterally extending groove provided on another insert to inhibit relative rotation between the inserts. Alternatively, a resiliently biased detent mechanism is provided along adjacent longitudinal edges of the inserts to inhibit relative rotation therebetween.

A salient feature of the present invention is the ability to readily remove the inserts from the longitudinal recesses of the hinged members. As will be appreciated, such feature allows one or more of the thrust bearing assemblies to be readily replaced without requiring complete disassembly of the hinge structure. Accordingly, the time required to replace any one or all of the bearing assemblies is substantially reduced and performance of the hinge structure is enhanced.

Numerous other features and advantages of the present invention will become readily apparent from the following detailed description, the accompanying drawings and the appended claims.

DETAILED DESCRIPTION OF THE INVENTION

Figure 1:
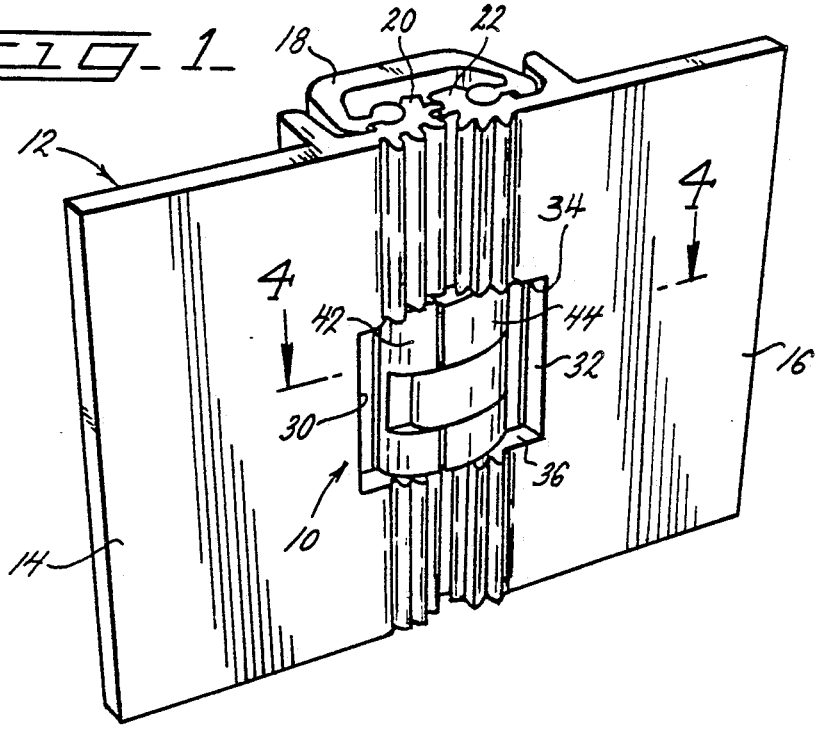
FIG. 1 is a fragmentary perspective view of an advantageous form of a thrust bearing assembly according to the present invention as arranged in the combination with a hinge structure.

While the present invention is susceptible of embodiment in various forms, there is shown in the drawings, and will hereinafter be described, preferred embodiments of the present invention with the understanding that the present disclosure is to be considered as exemplifications of the invention which are not intended to limit the invention to the specific embodiments illustrated.

Referring now to the drawings, wherein like reference numerals indicate like parts throughout the several views, a thrust bearing assembly 10 is schematically illustrated in combination with a hinge structure 12. As illustrated, the hinge structure 12 comprises first and second longitudinally extending hinge members 14, 16, respectively, which are rotatably joined along adjacent longitudinal edges. A longitudinally extending clamp member 18 maintains the hinge members 14, and 16 in a rotatable engagement relative to each other.

Figure 2:
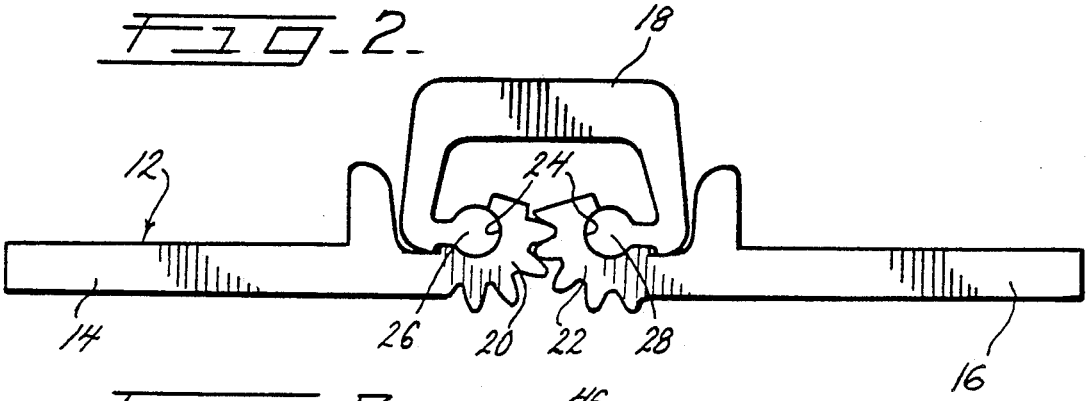
FIG. 2 is a top plan view of the hinge structure illustrated in FIG. 1.

Turning to FIG. 2, the first hinge member 14 is formed with a longitudinally extending gear segment or portion 20 at one longitudinal edge and has an outwardly extending leg portion integrally formed therewith. The second hinge member 16 is similarly formed with a longitudinally extending gear segment or portion 22 at one longitudinal edge and has an outwardly extending leg portion integrally formed therewith. Each gear segment 20, 22 defines a longitudinally extending channel 24 which provides each gear segment with a longitudinally extending cylindrical bearing surface which coincides with the axes of rotation of the respective segments 20, 22. As shown in FIG. 2, the gear teeth of the gear segments 20, 22 intermesh to rotatably join the hinge members 14, 16 to each other. As will be understood, the leg portions of the hinge members are secured to door panels (not shown) by any suitable fastener means such as screws or the like.

As best seen in FIG. 2, the longitudinally extending clamp member 18 has a generally channel-shaped or C-shaped cross section. The inwardly turned ends of the clamp member are formed with longitudinally extending rod-like bearing portions 26 and 28 which contact and cooperate with the cylindrical bearing surfaces defined by channels 24 at the axis of rotation of each hinge member. Although the members which comprise the hinge structure are interconnected by the longitudinally engagement of the gear segments 20, 22 and by the longitudinal engagement of the rod-like bearing portions 26 and 28 with the channels 24, the hinge members 16 and 18 are not in any way longitudinally interconnected. As a result, there is nothing, apart from friction, to prevent relative longitudinal movement of the hinge members 14, 16 relative to each other.

The thrust bearing assembly 10 of the present invention inhibits longitudinal movement of the hinge members 14, 16 relative to each other. As may be appreciated, more than one thrust bearing assembly may be provided along the length of the hinge structure to distribute the load bearing capability of the hinge structure over the length thereof. For purposes of discussion, however, only one thrust bearing assembly will be discussed in detail with the understanding that the other thrust bearing assemblies disposed along the length of the hinge structure may be substantially similar in construction.

Returning to FIG. 1, the hinge members 14, 16 define longitudinally co-extensive lateral recesses 30 and 32, respectively, along adjacent longitudinal edges thereof. As illustrated, each of the recesses 30, 32 includes upper and lower laterally extending surfaces 34 and 36, respectively.

The thrust bearing assembly 10 of the present invention is disposed within the lateral recesses 30, 32 defined by the hinge members 14, 16 and includes a pair of interengaging inserts 42 and 44. The interconnected or interengaging inserts 42, 44 extend laterally across the hinge members 14, 16 preferably beneath the gear segments 20, 22, respectively, to inhibit longitudinal movement of the hinge members relative to each other. Preferably, each of the inserts 42 and 44 is formed from a non-metallic material such as an acetal resin-type plastic. Such material is commonly sold under the trade name "Delrin" by DuPont Corporation.

The inserts 42, 44 define co-extensive upper and lower bearing surfaces 46 and 48, respectively against which the upper and lower surfaces 34, 36 of the recesses 30, 32, respectively, are adapted to slidably bear when the thrust bearing assembly 10 is disposed therewithin. The longitudinal dimension between the upper and lower surfaces 34, 36, respectively, of each of the recesses 30, 32 formed in the adjacent longitudinal edges of the hinge members 14, 16, respectively, and the longitudinal dimension between the bearing surfaces 46 and 48 of the inserts 40, 42 comprising the bearing assembly are such that there is just sufficient clearance therebetween to permit the hinge members 14, 16 to swing or to be rotated in an arcuate path travel without binding on the thrust bearing assembly.

Figure 3:
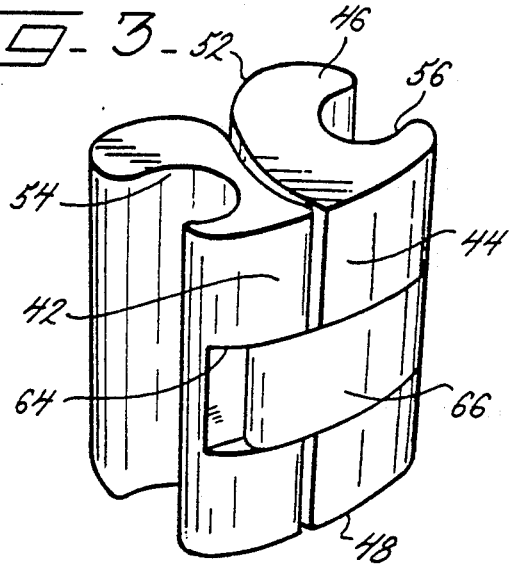
FIG. 3 is a perspective view of a thrust bearing assembly according to the present invention.
Figure 4:
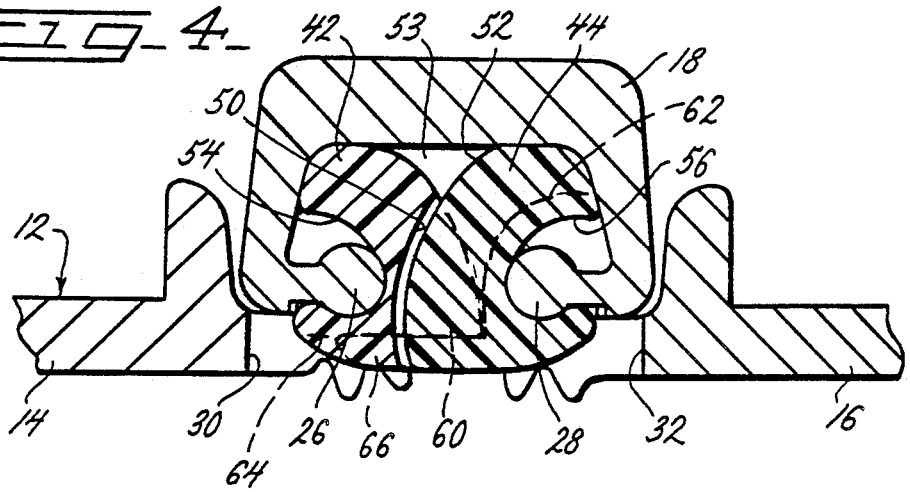
FIG. 4 is a enlarged fragmentary sectional view taken along line 4—4 of FIG. 1.

As illustrated in FIGS. 3 and 4, the inserts 42 and 44 are provided in side-by-side relation and have adjacent longitudinal edges 50 and 52, respectively, having complementary profiles which allow the inserts to be rotationally moved relative to each other. Preferably, longitudinal edge 50 of insert 42 has a concave-shaped profile extending along a majority of its length while longitudinal edge 52 of insert 44 has a convex-shaped profile. When disposed in side-by-side relation within the recesses 30, 32 of the hinge members 14, 16, respectively, the complementary profiles of the inserts 42, 44 define a longitudinally extending, relatively small recess or void 53 (FIG. 4) between themselves and a rear interior wall of clamp member 18.

It should be appreciated, however, that the combined cross-sectional configuration of inserts 42 and 44 advantageously conform essentially to the cross-sectional interior configuration of the clamp member 18 so as to limit rotational movement of the inserts relative to the clamp member 18. The cross-sectional configuration of the inserts 42, 44 further provides the upper and lower bearing surfaces 46 and 48 thereof with a relatively large planar surface area extending laterally across the hinged members 14, 16 in a supportive manner.

As illustrated in FIG. 4, insert 42 has a longitudinally extending, open-sided channel 54 defined along a longitudinal edge thereof disposed opposite to edge 50. As illustrated, channel 54 has a generally C-shaped cross-sectional configuration which accommodates the rod-like bearing portion 26 of the clamp member 18 and through which this rod-like bearing portion longitudinally extends. As will be appreciated, however, upon rotation of insert 42 the open side of channel 54 permits insert 42 to be readily removed from the recess 30 in the hinge member 14 within which it is accommodated.

Similarly, insert 44 has a longitudinally extending, open-sided channel 56 defined along a longitudinal edge thereof disposed opposite to edge 52. Channel 56 also has a generally C-shaped cross-sectional configuration which accommodates the rod-like bearing portion 28 of the clamp member 18 and through which this rod-like bearing portion longitudinally extends. Upon rotation of insert 44, the open side of channel 56 permits insert 44 to be readily removed from the recess 32 in the hinge member 16 within which it is accommodated.

Intermediate the upper and lower bearing surfaces 46 and 48, the inserts 42 and 44 are configured in an interengaging relationship which permits rotational and inhibits longitudinal movements of the inserts relative to each other. Preferably, the inserts 42 and 44 are joined to each other by a tongue-and-groove configuration defined along adjacent longitudinal edges of the inserts 42 and 44. As illustrated in FIG. 4, and approximately midway of its length, insert 42 is provided with a tongue-like projection 60 extending outwardly beyond the concave profile 50 provided along the remaining portion of the longitudinal edge of the insert 42. The tongue-like projection 60 on insert 42 is slidably received within and cooperates with a radial channel or groove 62 extending about the adjacent longitudinal edge 52 of insert 44 to inhibit longitudinal movements between the inserts 42, 44.

The bearing assembly of the present invention further includes a device for inhibiting inadvertent rotation of the inserts 42, 44 relative to each other during operation of the hinge structure. As illustrated in FIG. 3, insert 42 defines a laterally extending, open-sided groove or slot 64 arranged on a peripheral edge thereof. Insert 44 is provided with a tab-like projection 66 which is longitudinally aligned with the groove 64 on insert 42. Preferably, slot 64 is sized such that projection 66 may be received in a press-fit relationship therewith. As such, inadvertent rotation between the inserts 42 and 44 is inhibited.

Alternatively, a resiliently biased detent mechanism may be used to inhibit inadvertent rotation of the inserts 42, 44 relative to each other during operation of the hinged structure. The detent mechanism is disposed along adjacent longitudinal edges 50, 52 of the inserts 42, 44, respectively, for inhibiting relative rotation therebetween.

Figure 5:
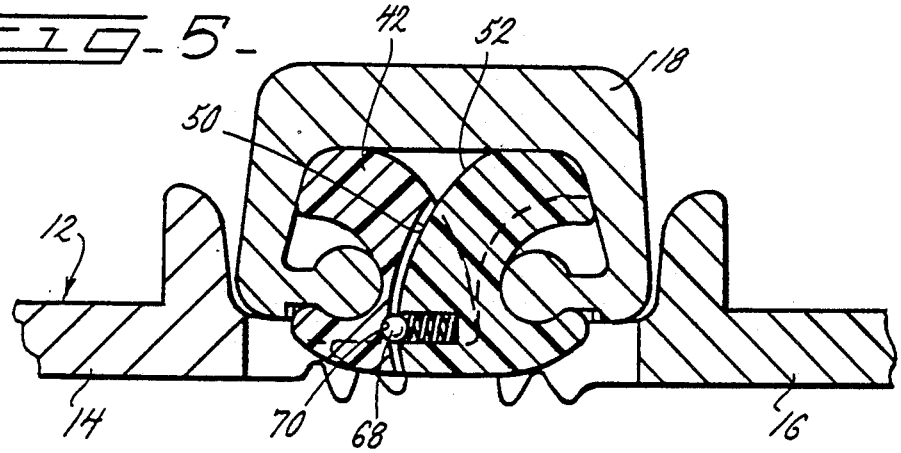
FIG. 5 is an enlarged fragmentary view similar to FIG. 4 illustrating a detent mechanism for inhibiting inadvertent rotational movement between inserts of the thrust bearing assembly.

The detent mechanism illustrated in FIG. 5 includes a spring biased ball 68 carried by insert 44 in a manner permitting radial displacement of the ball 68 but preventing its complete release from association with insert 44. A suitably sized detent 70 is suitably arranged on the confronting longitudinal edge 50 of insert 42. As will be understood, when ball 68 is resiliently biased into cooperation with the detent 70 inadvertent relative rotation between the inserts 42 and 44 is inhibited.

Figure 7:
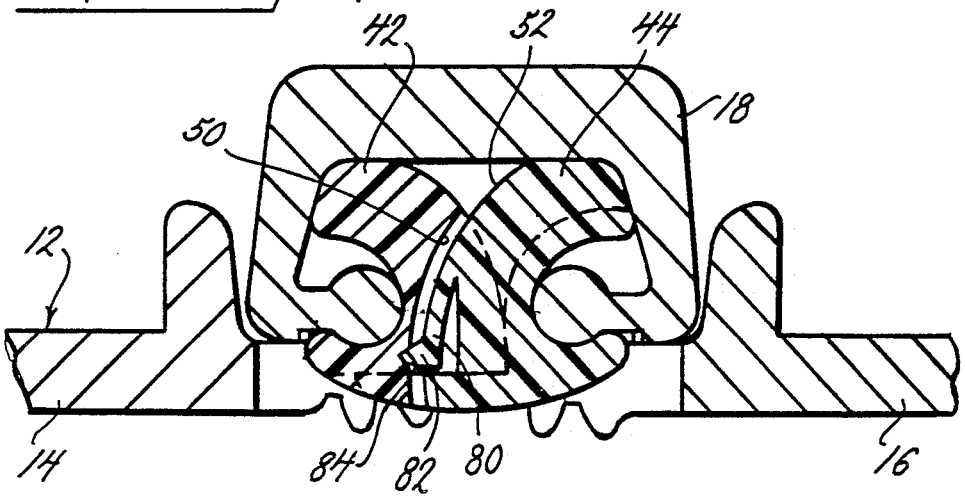
FIGS. 7 and 8 are enlarged fragmentary views similar to FIG. 5 which schematically illustrate other forms of detent mechanisms for inhibiting inadvertent rotational movement between inserts of the thrust bearing assembly.
Figure 8:
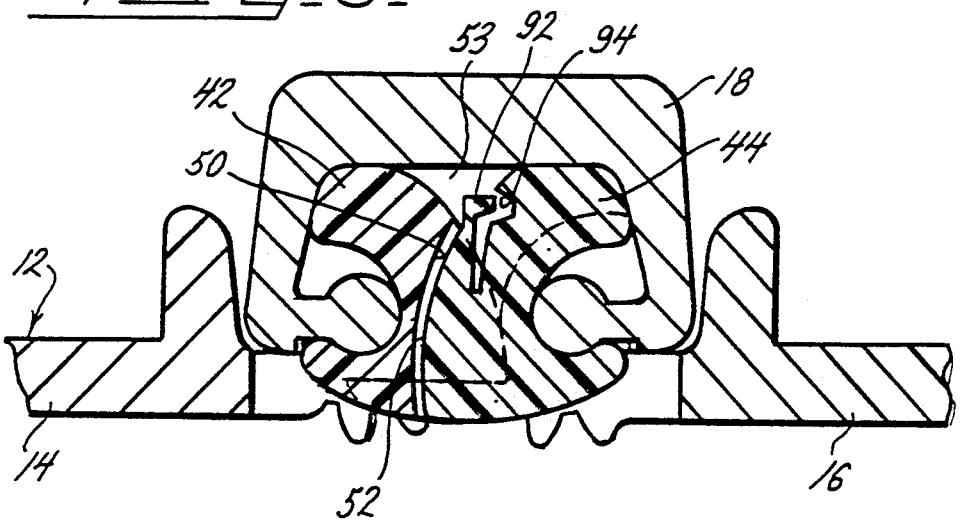

Other forms of detent mechanisms are illustrated in FIGS. 7 and 8. As illustrated in FIG. 7, insert 44 includes a finger or arm 80 which is disposed along edge 52 and is resiliently biased outwardly toward edge 50 defined on insert 42. Preferably, finger 80 is provided as an integral part of insert 44 but could also be fastened or secured thereto. The free end of finger 80 is provided with an outward projection 82 which, under the resilient influence of finger 80, seats within a suitably arranged detent 84 defined on the confronting longitudinal edge 50 of insert 42. As will be understood, when projection 82 is resiliently biased into cooperation with the detent 84, inadvertent relative rotation between the inserts 42 and 44 is inhibited.

The alternative form of detent mechanism illustrated in FIG. 8 includes a finger 90 which is disposed along edge 52 and is resiliently biased outwardly toward edge 50 defined on insert 42. Preferably, finger 90 is provided as an integral part of insert 44 but could also be fastened or secured thereto. The free end of finger 90 is provided with a projection 92 which is arranged so as to outwardly project into the recess or void 53 defined rearwardly of the inserts 42 and 44. Insert 44 further defines a recess 94 which accommodates the projection 92 when it is deflected inwardly as insert 44 is rotatably moved relative to insert 42. As will be understood, the projection 92 is resiliently biased outwardly sufficiently to interfere or abut against surface 50 of insert 42 in a manner inhibiting inadvertent relative rotation between the inserts 42 and 44.

In operation, the thrust bearing assembly 10 is disposed within the lateral recesses 30, 32 and extends laterally across the adjacent longitudinal edges of the hinge members 14, 16 so as to effectively prevent relative longitudinal movement between the hinge members. A salient feature of the present invention is the ability to completely replace the thrust bearing assembly while maintaining the hinge members 14, 16 in mesh with each other.

The ability of the present invention to permit total replacement of the thrust bearing assembly is effected by providing two non-metallic inserts 42 and 44 which are received within the recesses 30, 32 of the hinge members and are configured to permit rotational and inhibit longitudinal movement relative to each other. As will be appreciated, the inability of the inserts 42, 44 to longitudinally move relative to each other likewise inhibits longitudinal movements of the hinge members 14, 16 relative to each other.

The two joined inserts 42 and 44 combine to provide non-metallic upper and lower bearing surfaces 46 and 48 which slidably engage the upper and lower surfaces 34 and 36, respectively, of the hinge members 14 and 16 in a manner inhibiting relative longitudinal movement therebetween. The non-metallic bearing surfaces on the inserts of the bearing member also serve to reduce sliding frictional engagement between the hinge members 14, 16 and the bearing assembly 10 in a manner decreasing the wear and, thereby, durability of the hinge structure.

Figure 6:
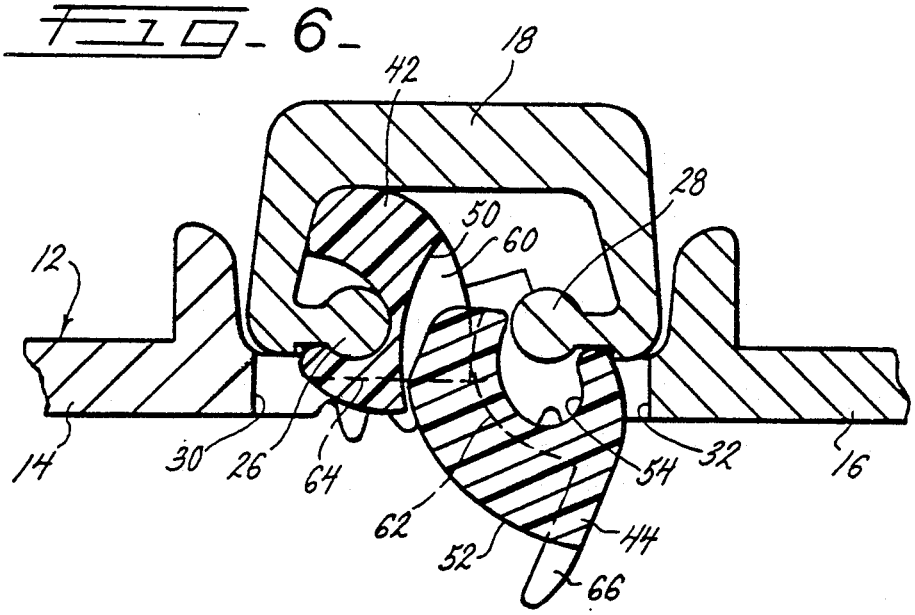
FIG. 6 is an enlarged fragmentary elevational view schematically illustrating one of the inserts rotated for removal from the hinge structure.

Replacement of the bearing assembly while maintaining the integrity of the hinge structure is relatively simple. To effect replacement of the bearing assembly, and as illustrated in FIG. 6, projection 66 is freed from its releasably locked association with the insert 42 by having an operator grasp the free end of the projection and rotate insert 44 relative to insert 42. After releasing the projection 66 from groove 64, insert 44 is rotated about 90 degrees relative to insert 42 as permitted by the profiles 50, 52 on the adjacent longitudinal edges of the inserts.

After suitably rotating the insert 44, the open side of the C-shaped channel 54 permits removal of insert 44 from its rotatable association with the rod-like member 28 of clamp member 18 and from the longitudinally extending recess 32 defined by the hinge member 16. Thereafter, insert 42 may be removed from the recess 30 and hinge member 14 as by rotation of the insert 42 until the open-sided channel 52 is suitably positioned to permit removal of the insert 42 from the recess 30. As will be appreciated, reversal of this process will permit new inserts comprising a new thrust bearing assembly to be inserted within the longitudinally extending recesses 30, 32 of the hinge members while maintaining the hinge members 14, 16 in mesh.

In the embodiment illustrated in FIG. 4 and 6, the press-fit cooperative relationship established between the tab-like projection 66 and groove 64 maintains the inserts 42, 44 in proper relationship and inhibits inadvertent relative rotation therebetween during operation of the hinge structure.

Alternatively, the detent mechanisms illustrated in FIGS. 5, 7 and 8 can be used for maintaining the inserts 42, 44 in proper relation. In each of the illustrated detent mechanisms, forced rotation of the insert 44 under the influence of an operator will effectively overcome the resilient force provided by the detent mechanism for maintaining the inserts 42, 44 in side-by-side association and thereafter allowing the inserts 42 and 44 to be rotatably moved relative to each other to effect replacement of the bearing assembly. As will be appreciated, the ability to replace inserts 42 and 44 comprising the bearing assembly 10 without requiring disassembly of the hinge structure leads to reduced maintenance time and thereby costs.

This invention has been described in terms of specific embodiment set forth in detail, but it should be understood that this is by way of illustration only and that the invention is not necessarily limited thereto. Modifications and variations will be apparent from the disclosure and may be resorted to without departing from the spirit of the invention, as those skilled in the art will readily understand. Accordingly, such variations and modifications of the disclosed products are considered to be within the purview and scope of the invention and the following claims.

What is claimed is:

1. A thrust bearing assembly for a hinge structure including two geared hinge members and a clamp member, the geared hinged members being in intermeshing relation when the hinge structure is assembled and are longitudinally movable relative to each other with the clamp member maintaining the geared hinge members in mesh as they rotate, said thrust bearing assembly comprising:

a pair of interengaging inserts removably disposed in adjacent longitudinal co-extensive recesses defined along adjacent longitudinal edges of each hinge member and extending laterally across the hinge members to inhibit their longitudinal movement relative to each other, said inserts being configured to inhibit longitudinal movements relative to each other when disposed in the recesses of the hinge members while permitting said inserts to be rotationally moved relative to each other to facilitate removal of the thrust bearing assembly without requiring disassembly of the hinge members of the hinge structure.

2. The thrust bearing assembly according to claim 1 wherein said inserts slidably interengage with each other along adjacent longitudinal edges, with said longitudinal edges of said inserts having complementary profiles which allow the inserts to rotationally move relative to each other.

3. The thrust bearing assembly according to claim 1 wherein said inserts have a tongue-and-groove configuration defined along adjacent longitudinal edges to permit slidable interengagement and inhibit longitudinal movements of the inserts relative to each other.

4. The thrust bearing assembly according to claim 1 wherein each of said inserts are configured to define a longitudinally extending open-sided channel which accommodates an inwardly turned end of said clamp member, the open side of the channel permitting removal of the insert from the longitudinally extending recess defined by the hinge members upon manipulation of the inserts relative to each other.

5. The thrust bearing assembly according to claim 1 wherein said pair of inserts define co-extensive upper and lower bearing surfaces which slidably contact upper and lower surfaces of the recesses defined by each hinge member.

6. The thrust bearing assembly according to claim 1 wherein said thrust bearing assembly further includes means for inhibiting inadvertent movement of the inserts relative to each other.

7. The thrust bearing assembly according to claim 6 wherein said means for inhibiting inadvertent movement of the inserts includes a lateral projection provided on one insert to extend across and be received in releasable locking relation with a laterally extending groove defined on an adjacent insert to readily allow operator access thereto.

8. The thrust bearing assembly according to claim 1 wherein said pair of inserts are formed from a non-metallic material to enhance slidability between the inserts and the hinge members.

9. A thrust bearing assembly for a pinless hinge structure including two rotatable hinge members and a clamp member, said hinge members being longitudinally movable relative to each other and are rotatably joined along adjacent longitudinal edges by intermeshing gear segments forming part of and which allow said hinge members to longitudinally move relative to each other with said clamp member maintaining the gear segments in mesh, said thrust bearing assembly comprising:

at least two inserts disposed in side-by-side relation in adjacent longitudinally co-extensive recesses defined along adjacent longitudinal edges of each hinge member and extending laterally across the hinge members to inhibit relative longitudinal movements therebetween, said inserts being joined to each other by a tongue-and-groove configuration defined along adjacent longitudinal edges of the inserts and which inhibits longitudinal movement therebetween and permits the inserts to be rotationally moved relative to each other to facilitate insertion and removal of the thrust bearing assembly into and from the hinge structure while maintaining the hinge members in mesh with each other.

10. The thrust bearing assembly according to claim 9 wherein an adjacent longitudinal edge of one insert has a convex-shaped profile while an adjacent longitudinal edge of the other insert has a concave-shaped profile, said profiles permitting the inserts to be rotationally displaced relative to each other.

11. The thrust bearing assembly according to claim 9 wherein each of said inserts defines a longitudinally extending generally C-shaped channel which rotatably accommodates an inwardly turned end of said clamp member, the shape of said channel permitting removal of each insert from the recesses defined by the hinge members upon rotation of the inserts relative to each other.

12. The thrust bearing assembly according to claim 9 wherein each of said inserts have non-metallic upper and lower bearing surfaces which slidably engage upper and lower surfaces of the recesses defined by the hinge members.

13. The thrust bearing assembly according to claim 9 further including a detent mechanism disposed along the adjacent longitudinal edges of the inserts to inhibit inadvertent rotational movements of the inserts relative to each other.

* * * * *